US007179207B2

(12) United States Patent
Gerschefske

(10) Patent No.: US 7,179,207 B2
(45) Date of Patent: Feb. 20, 2007

(54) EXERCISE APPARATUS WITH RESILIENT FOOT SUPPORT

(75) Inventor: Kevin Gerschefske, Springfield, MO (US)

(73) Assignee: Stamina Products, Inc., Springfield, MO (US)

( * ) Notice: Subject to any disclaimer, the term of this patent is extended or adjusted under 35 U.S.C. 154(b) by 389 days.

(21) Appl. No.: 10/693,443

(22) Filed: Oct. 27, 2003

(65) Prior Publication Data

US 2004/0142800 A1 Jul. 22, 2004

Related U.S. Application Data

(60) Provisional application No. 60/440,610, filed on Jan. 17, 2003.

(51) Int. Cl.
*A63B 21/00* (2006.01)

(52) U.S. Cl. ..... 482/95; 482/96

(58) Field of Classification Search ..... 482/95–97, 482/140, 142, 130, 121, 72
See application file for complete search history.

(56) References Cited

U.S. PATENT DOCUMENTS

| | | | | |
|---|---|---|---|---|
| 1,996,350 | A | 4/1935 | Schaff | |
| 4,477,070 | A | 10/1984 | Appelbaum | |
| 4,564,193 | A | 1/1986 | Stewart | |
| 4,706,953 | A | 11/1987 | Graham | |
| 4,722,520 | A | 2/1988 | Lee | |
| 4,836,530 | A | 6/1989 | Stanley, Jr. | |
| 4,884,802 | A | 12/1989 | Graham | |
| 4,911,438 | A | 3/1990 | Van Straaten | |
| 5,066,005 | A | 11/1991 | Luecke | |
| 5,071,115 | A | 12/1991 | Welch | |
| 5,169,363 | A * | 12/1992 | Campanaro et al. | 482/96 |
| 5,215,511 | A | 6/1993 | Cheng | |
| 5,312,315 | A | 5/1994 | Mortensen et al. | |
| 5,338,278 | A | 8/1994 | Endelman | |
| 5,364,327 | A | 11/1994 | Graham | |
| 5,445,583 | A | 8/1995 | Habing | |
| 5,622,527 | A | 4/1997 | Watterson et al. | |
| 5,634,870 | A | 6/1997 | Wilkinson | |
| 5,788,606 | A * | 8/1998 | Rich | 482/27 |
| 5,792,033 | A | 8/1998 | Merrithew | |
| 5,967,955 | A * | 10/1999 | Westfall et al. | 482/142 |
| 6,042,523 | A | 3/2000 | Graham | |
| 6,135,922 | A * | 10/2000 | Nissen | 482/27 |
| 6,186,929 | B1 * | 2/2001 | Endelman et al. | 482/121 |
| 6,280,367 | B1 * | 8/2001 | Arsenault | 482/140 |
| 6,338,704 | B1 | 1/2002 | Endelman | |
| 6,371,895 | B1 | 4/2002 | Endelman et al. | |
| 6,500,099 | B1 | 12/2002 | Eschenbach | |
| 6,527,685 | B2 | 3/2003 | Endelman et al. | |
| 6,752,745 | B1 * | 6/2004 | Davis | 482/72 |
| 2002/0058573 | A1 | 5/2002 | Endelman et al. | |

* cited by examiner

*Primary Examiner*—Jerome Donnelly
(74) *Attorney, Agent, or Firm*—Pillsbury Winthrop Shaw Pittman, LLP

(57) ABSTRACT

An exerciser including a movable body support mounted on an exerciser frame for movement along tracks provided by the frame. A movable foot support extends from the exerciser frame. The movable foot support is adapted to be engaged by the user's feet to absorb the energy of movement in a first direction and to provide the user with a bouncing movement, which the user may translate into a movement of the movable body support in the opposite direction. The movable foot support may be provided as an attachment and retrofitted to existing exercisers. The exerciser may include a resilient resistance system coupled to the movable body support and a set of pull lines with user grips trained over pulleys carried by the exerciser frame. Also disclosed are methods for enabling users to exercise.

12 Claims, 11 Drawing Sheets

EXERCISE APPARATUS WITH RESILIENT FOOT SUPPORT

CROSS-REFERENCE TO RELATED APPLICATIONS

This application claims priority to U.S. Provisional Application No. 60/440,610 filed Jan. 17, 2003. The contents of that application are incorporated by reference herein in their entirety.

BACKGROUND OF THE INVENTION

1. Field of the Invention

The present invention relates to methods of exercising and to exercise apparatuses with resilient foot supports for carrying out those methods.

2. Description of Related Art

One of the consistent challenges in the fitness industry is devising exercise methods and apparatuses that allow the user to achieve maximum, diverse fitness effects by performing exercises in comfortable positions. For example, a type or set of exercises may be particularly attractive and beneficial to the user if it provides strengthening, toning and cardiovascular benefits. Exercise equipment used to perform fitness exercises should ideally be relatively simple in construction, flexible in the types of exercises allowed, and adaptable to a wide range of resistances and levels of exertion.

A popular type of exercise equipment provides a pair of generally parallel tracks, on which a carriage is mounted for sliding or rolling movement along the tracks. Depending on the particular variation, the carriage may be connected to a resistance system including one or more resilient members, such as springs or bungee cords, which bias the carriage towards a particular position. The carriage may also be connected to pull lines that are trained over a pulley system, allowing the user to move the carriage by pulling the pull lines. The user exercises with such an apparatus by using the arms or legs to move the carriage along the tracks.

Sliding-carriage multi-function exercise equipment of this type also typically includes a foot rest or foot bar which extends in a direction generally perpendicular to the rails. The foot rest or foot bar is operationally fixed in position, and allows a user to control the movement of the carriage by exerting his or her leg muscles against it. A foot rest typically includes a set of frame members or frame portions that are adapted to connect at a first end to either the rails of the apparatus or other appropriate structures provided for that purpose. At their respective second ends, the frame members are attached to a rigid member, such as a board. The board is typically covered with a layer of foam or other cushioning material, which may be enclosed in a layer of outer material, such as vinyl. The foam and outer material cushion the user's feet to some degree and provide traction.

A foot bar is a generally U-shaped and typically hollow bar that is adapted to be connected to the exercise apparatus at its ends. The top portion of the foot bar is covered with a traction/cushioning material. The user typically places his or her hands or feet on the cushioned portion of the foot bar to control the movement of the carriage.

One variation of the above-described type of exercise apparatus is disclosed in U.S. Pat. No. 5,967,955, which is incorporated herein by reference in its entirety. The disclosed apparatus includes a movable carriage mounted on generally parallel tracks and a foot rest of the type described above. The apparatus does not use resilient members to provide resistance; instead, resistive bias is provided by inclining the tracks at one of a number of angular orientations, thereby allowing the user to move the carriage by working against a corresponding fraction of his or her own weight bias under the influence of gravity using a pulley system that is coupled to the carriage. As the angular orientation of the carriage changes, the fraction of the user's weight bias changes correspondingly, such that at greater inclinations, the weight bias that the user works against is greater.

Another variation of the above-described type of exercise apparatus is that sold under the general name Pilates Performer≐ (Stamina Products, Inc., Springfield, Mo., United States) for use with the Pilates exercise system. An apparatus of this type is shown in U.S. Pat. No. D. 382,319 to Gerschefske et al., the contents of which are incorporated by reference in their entirety. The apparatus includes a frame having a pair of generally parallel tracks that support a movable carriage which is mounted on the tracks with rollers for rolling horizontal movement along the tracks. A set of tensile resilient resistance elements is connected to the frame at one end and to the carriage at the other, thereby biasing the carriage towards a particular position. A pulley system and associated pull lines are coupled to the carriage, such that the carriage may be moved by application of force to the pull lines. A foot bar is provided at one end of the frame, and shoulder blocks are provided at one end of the carriage, allowing the user to position him or herself in a supine position to move the carriage against the resilient bias provided by the tensile resilient resistance elements using the muscles of either the legs or the arms.

SUMMARY OF THE INVENTION

One aspect of the invention relates to a method of enabling a person to exercise. The method comprises providing a movable body support for the exercising person which supports the exercising person in a position which allows the body of the exercising person to move with the movable body support while the feet of the exercising person are free to be moved with respect to the movable body support and providing a movable foot support separate from the body support in a position to be engaged by the feet of the exercising person supported on the movable body support. The method also comprises providing for the absorption of the energy of the movement of the movable body support in a first direction away from the movable foot support by the exercising person supported thereon and the conversion of the absorbed energy to a movement of the movable body support with the exercising person supported thereon in a second direction toward the movable foot support. Additionally, the method comprises providing for the controlled yielding of the movable foot support caused by the engagement thereof by the feet of the exercising person moving with the movable body support in the second direction and establishing as a result of the controlled yielding a bouncing movement by the movable foot support in the first direction, which the exercising person can translate into a movement of the movable body support in the first direction. The arrangement is such that the exercising person can control the repetition and magnitude of the movements of the movable body support by flexure of the legs at the knees.

Another aspect of the invention relates to an exerciser. The exerciser comprises a a frame assembly, a movable body support disposed on the frame assembly and constructed and arranged to support the body of an exercising person in a position which allows the body of the exercising person to move with the movable body support while enabling the feet of the exercising person to be free to be moved with respect to the movable body support, and a movable foot support disposed on the frame assembly and constructed and arranged to be engaged by the feet of the exercising person supported on the movable body support. The movable body support is mounted on said frame assembly for movement in a first direction away from the resiliently movable foot support and a second direction toward the movable foot support, and is constructed and arranged to absorb the energy of a movement thereof in the first direction by a user supported thereon and to convert the absorbed energy into a movement thereof with the exercising person supported thereon in the second direction. The resiliently movable foot support is constructed and arranged to yield resiliently in response to the engagement of the feet of the user moving with the movable body support in the second direction and to establish, as a result of the resilient yielding, a bouncing movement by the resiliently movable foot support in the first direction, which can be translated by the user into a movement of the movable body support in said first direction.

A further aspect of the invention relates to an attachment for an exerciser of the type including a movable body support disposed on a frame assembly in a position to support the body of an exercising person in a position which allows the body of the exercising person to move with the movable body support while enabling the feet of the user to be free from the movable body support, a foot assembly adapted to be mounted on the frame assembly in a position to be engaged by the feet of the exercising person supported on said movable body support, and mounting structure disposed on the frame assembly, the mounting structure being constructed and arranged to detachably mount the foot assembly to the frame structure. The attachment comprises a movable foot support constructed and arranged to cooperate with the mounting structure to be mounted on the frame assembly in lieu of the foot assembly in a position to be engaged by the feet of a user supported on the movable body support. The movable foot support is constructed and arranged to yield resiliently in response to the engagement of the feet of the user supported on the movable body support therewith in a second direction toward the movable foot support and to establish, as a result of the resilient yielding, a bouncing movement by the movable foot support in a first direction which can be translated by the user into a movement in said first direction of said movable body support.

Other aspects of the invention will become apparent from the following description.

BRIEF DESCRIPTION OF THE DRAWINGS

The invention will be described with reference to the following drawings, in which like numerals represent like features throughout the figures, and in which.

DETAILED DESCRIPTION

Figure 1:
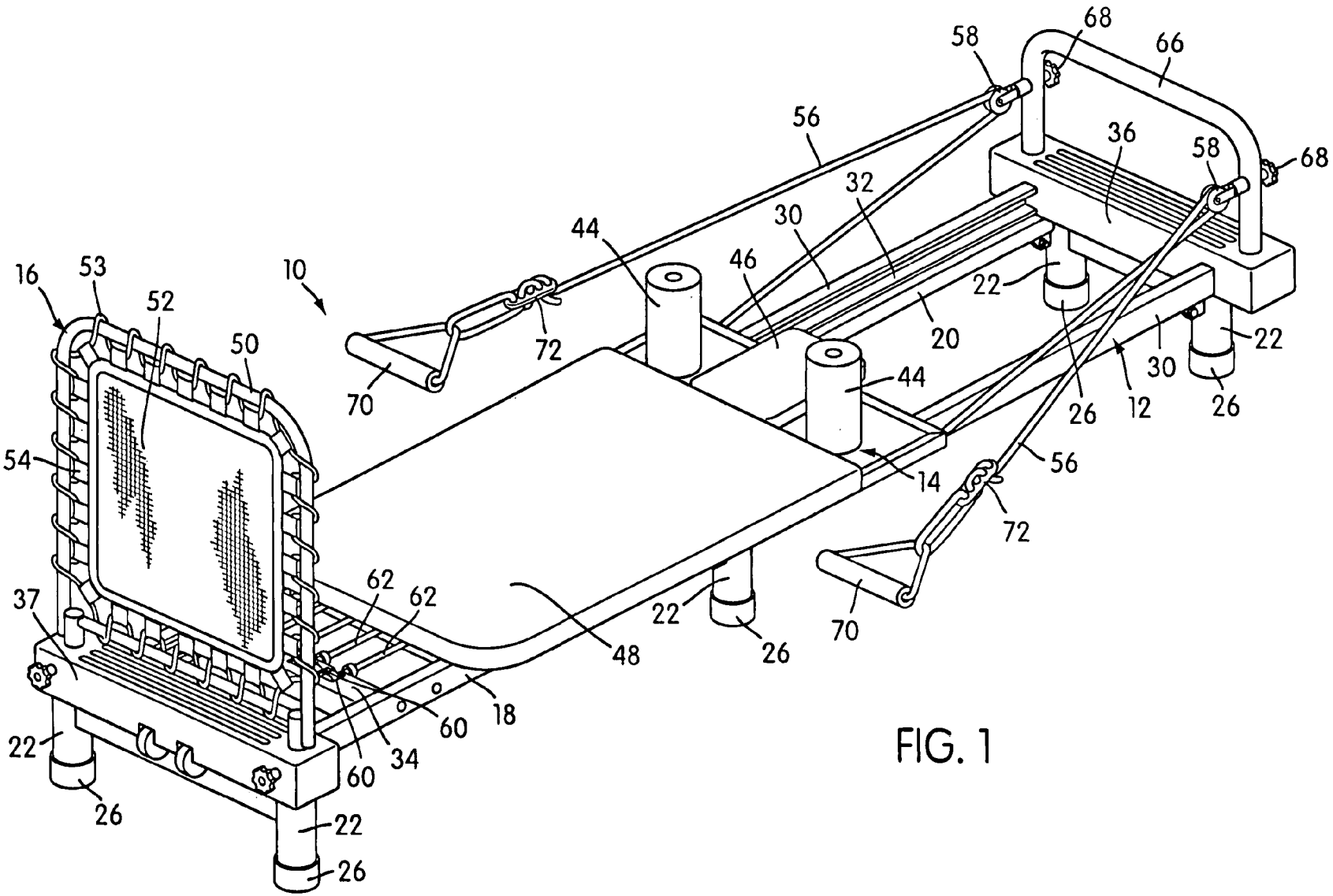
FIG. 1 is a perspective view of an exerciser according to an embodiment of the present invention.

FIG. 1 is a perspective view of an exerciser, generally indicated at 10, according to one embodiment of the invention. The exerciser 10 is generally of the type shown in U.S. Pat. Des. 382,319, which was incorporated by reference above. The exerciser 10 includes a frame assembly, generally indicated at 12, a translationally movable body support, generally indicated at 14, disposed on the frame structure 12 in a position to support the body of the user in a position enabling the feet of the user to be free from the movable body support 14, and a resiliently movable foot support or trampoline, generally indicated at 16, constructed and arranged to be mounted on the frame structure 12 in a position to be engaged by the feet of the user supported on the movable body support 14.

Figure 2:
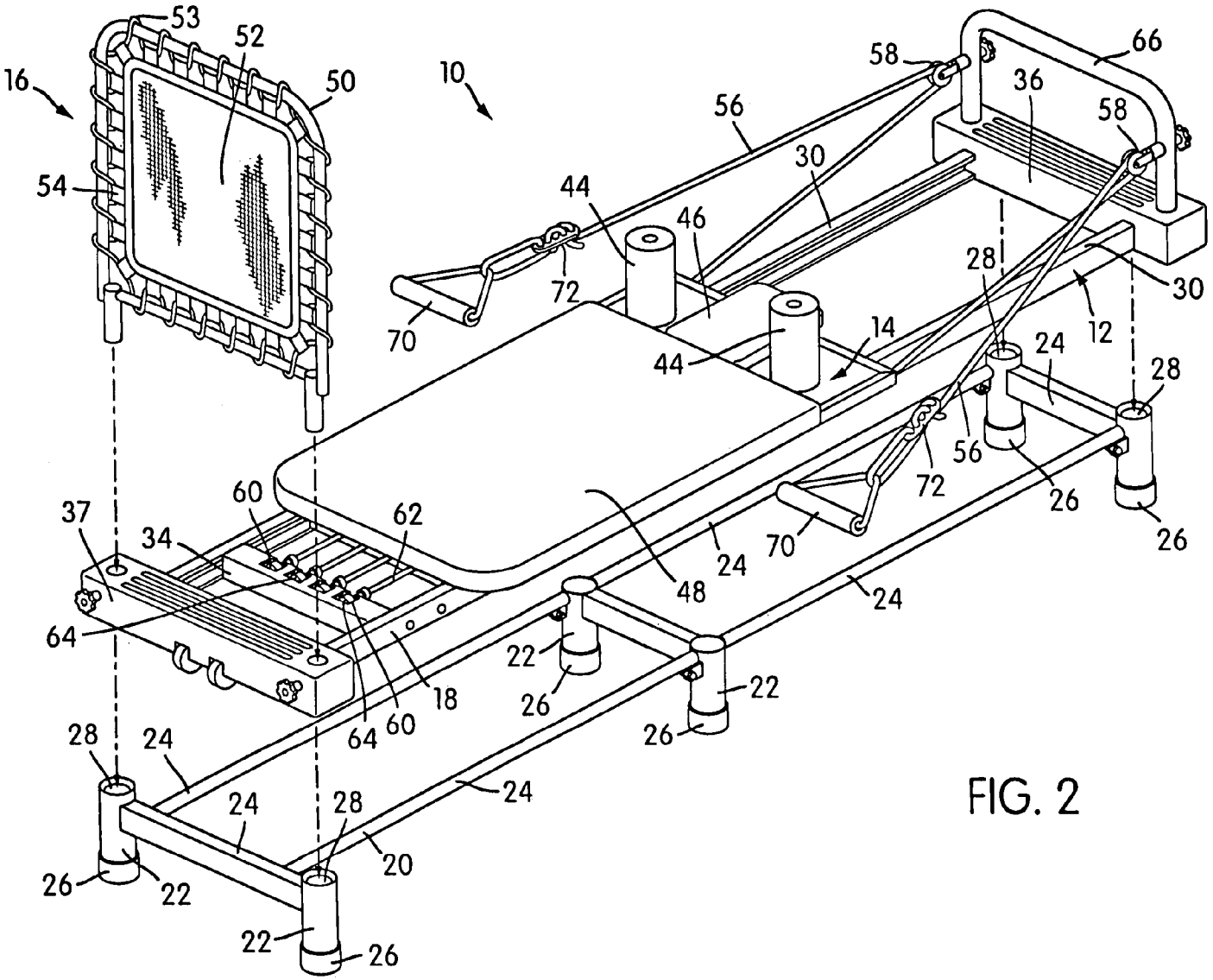
FIG. 2 is an exploded perspective view of the exerciser of FIG. 1.

The frame assembly 12 includes a frame 18, which is adapted to support the movable body support 14, the foot support 16, and the user, as well as a stand 20, which is adapted to connect to the frame 18 to hold the frame 18 in a generally horizontal plane above floor level. As is shown in FIG. 2, an exploded perspective view of the exerciser 10, the stand 20 comprises a plurality of legs 22 connected at respective upper ends thereof by cross bars 24, such that the stand portion 20 is comprised of generally rectangular or trapezoidal segments having legs 22 disposed at the corners of the segments. End caps 26 of a rubber or other non-skid material may be provided at floor-contacting ends of the legs 22. Upper receptacle sections 28 of the stand 20 are adapted to receive corresponding mating structures provided on the underside of the frame 18 (not shown in the Figures), so as to operatively secure the frame 18 to the stand 20. The legs 22 of the stand 20 may be of any length that provides a convenient user height for the frame portion 18.

Depending on the embodiment, the frame 18 and stand 20 may be separable, so that the exerciser 10 can be stored easily. Additionally, the stand 20 may be omitted or sold separately, particularly if the height provided by the stand 20 is not required for the exercises that are to be performed. Moreover, it may be desirable to construct the stand 20 such that one end is wider than the other. A stand 20 with one wider end and one narrower end may be desirable if one end of the exerciser 10 requires a broader base of support to prevent lateral tipping, or if the exerciser 10 is constructed such that the stand 20 will only mate with the frame 18 if the frame 18 is in a particular orientation.

The frame 18 is comprised of two generally parallel support tracks 30, connected and braced by a number of cross members. Each of the support tracks 30 has a generally C-shaped cross-section, such that each support track 30 defines an interior track 32, in the shape of a channel, which is adapted to receive engaging portions of the movable body support 14. The engaging portions of the movable body support 14 in this embodiment are rollers 33 (shown in phantom in FIG. 3) that rollingly engage interior tracks 32. The rollers 33 are mounted to the underside of the movable body support 14 on appropriately-sized bearings or projections, and allow the movable body support 14 to roll along the support tracks 30 between limiting portions of the support tracks 30. The limiting portions of the support tracks 30 define the extent of travel for the movable body support 14. In the exerciser 10, one of the limiting portions is a crossbar 34 that extends between the two support tracks 30; the other limiting portion is defined by an endpiece 36 of the frame portion 18. Alternatively, the limiting portions may simply be the ends of the grooves 32 in the support tracks 30.

Although rollers 33 are used in the illustrated embodiment, a number of bearings and other movement support structures are known in the art, and any one of these known types of bearings may be used in place of the rollers. For example, instead of rollers, blocks of low-friction material may be used, and the inside tracks 32 in the support tracks 30 may be lubricated in order to facilitate sliding movement with reduced friction.

Figure 3:
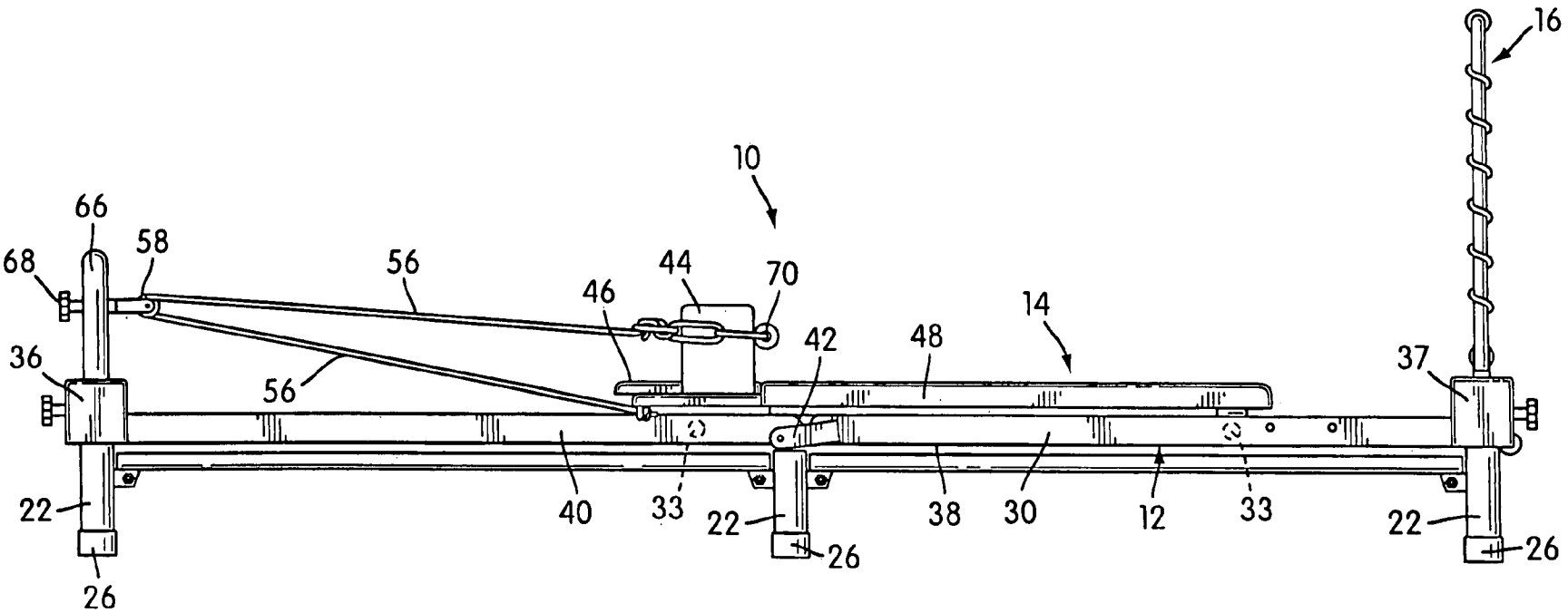
FIG. 3 is a side elevational view of the exerciser of FIG. 1.

The support tracks 30 may be continuous bars that run the length of the exerciser, or they may be comprised of sets of shorter bars which are secured together by welds or fasteners. As shown in FIG. 3, each support track is comprised of two shorter support bars 38, 40. At one end, each shorter support bar 38, 40 connects to an endpiece 36, 37 to form an end of the frame 18 of the exerciser 10. (The endpieces 36, 37 of the illustrated embodiments are bars covered with decorative plastic moldings, but they may be made in other configurations.) At the other ends of the shorter support bars 38, 40, cooperating hinge structure 42 is provided, such that the shorter support bars 38, 40 may be hingedly connected together in a manner which allows the exerciser 10 to be folded when not in use.

In alternative embodiments of the invention, the support tracks may have a substantially rectangular cross section, and a movable body support with rollers or other movement support structures may be configured so as to rest on top of the support tracks, rather than engaging inside tracks defined within them. The precise manner of engagement of the movable body support and the support tracks is not critical.

Several body-engaging components are mounted on the movable body support 14 so as to facilitate the body positioning of the user. Two padded shoulder blocks 44, one on each side of the body support 14, extend vertically, and are positioned so as to engage the upper portion of the user's torso (i.e., at the collarbone or shoulder region) when the user is lying prone or supine on the movable body support 14, so as to prevent the user from sliding relative to the movable body support 14 in a direction away from the foot support 16. The shoulder blocks 44 may be removably attached to the movable body support 14, for example, by a threaded connection.

A padded head rest 46 is also mounted on the movable body support 14. In the position illustrated in FIGS. 1 and 2, the head rest 46 is positioned such that its user-contacting surface is generally horizontal and co-planar with those of the movable body support 14. However, the head rest may be mounted on a multi-position bracket, such that its angular position may be adjusted relative to that of the movable body support so as to support the user's head in an inclined position. In addition to the head rest 46, torso pad 48 is mounted on the movable body support 14 so as to cover a substantial portion of the movable body support 14 to provide traction and comfort.

Figure 4:
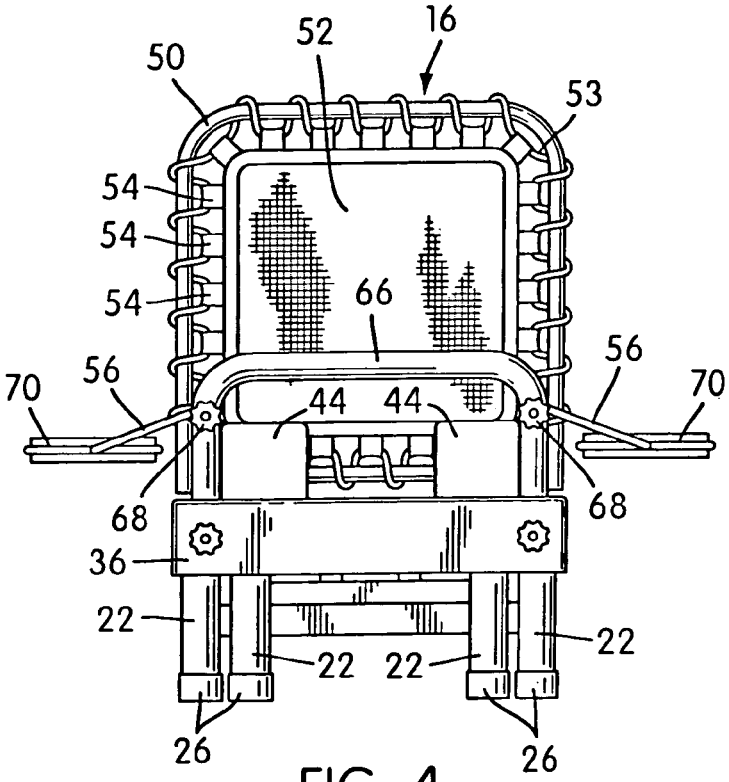
FIG. 4 is an elevational view of one end of the exerciser of FIG. 1.
Figure 5:
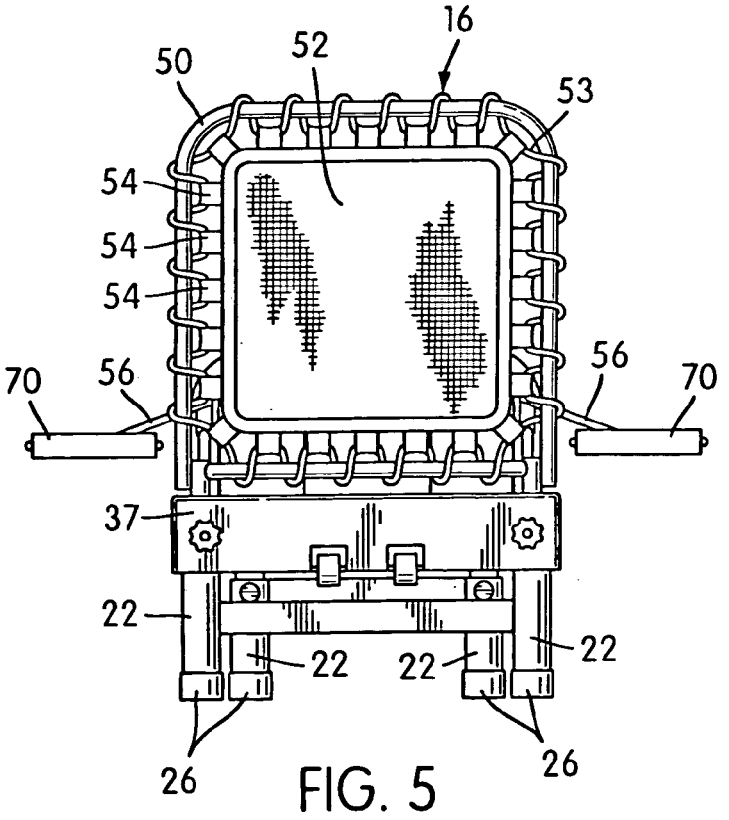
FIG. 5 is an elevational view of the other end of the exerciser of FIG. 1.

When the user is lying on the movable body support 14 in either prone or supine position with his or her head on the head rest, the user's feet are free to move with respect to the movable body support 14, and extend in a direction toward the resiliently movable foot support 16. As can be seen in FIG. 1 and in the end elevational views of FIGS. 4–5, in one embodiment, the foot support 16 comprises a generally rectangular peripheral frame member 50 that extends vertically, perpendicular to the orientation of the movable body support 14. Resiliently attached to the peripheral frame member 50 is a flexible sheet member 52. In the illustrated embodiment, the peripheral frame member 50 has a generally circular cross section, and a fabric flexible sheet member 52 is attached to the peripheral frame member 50 by a series of elastomeric, resilient, extensible cords 53 that are wrapped around the peripheral frame member 50 and pass through eyelets 54 provided along the edges of the fabric flexible sheet member 52. The fabric flexible sheet member 52 may be nylon, canvas, or another suitable fabric capable of withstanding exercising use. The elastomeric, resilient, extensible cords 53 may comprise, for example, several strands of an elastomeric rubber encased in a fabric outer casing.

In addition to the arrangement shown in the figures and described above, the foot support 16 may be made in a variety of configurations and of a number of materials. For example, instead of being wrapped around the frame member, elastomeric cords or tension coil springs could be secured at first ends within the interior of a hollow peripheral frame member and could extend from it, being secured to the flexible sheet member at respective second ends. Alternatively, the flexible sheet member itself may be made of a resilient, elastomeric material, such as rubber, and may be secured to the frame member with adhesives or fasteners, without elastomeric cords. Moreover, the foot support could comprise an inflated resilient bladder supported by a peripheral frame or a rigid backing member, or it could comprise a board or other rigid member resiliently mounted on springs. In general, other embodiments of the invention would be designed to simulate the type of motion produced using the foot support 16. Other embodiments of the foot support will be described in more detail below.

The exerciser 10 also carries a resilient resistance system coupled to the movable body support 14. The crossbar 34 proximate to the footrest has several slots 60 formed in it. Each slot 60 in the crossbar is sized and adapted to accept one end of a tensile resilient resistance element 62. A bracket on the underside of the movable body support 14 (not shown in the figures) includes a corresponding set of slots 60, each slot 60 adapted to accept the other end of a tensile resilient resistance element 62. In this embodiment, the crossbar 34 and bracket of the movable body support 14 each include four slots 60; however, the number of slots 60 may be selected arbitrarily, depending on the total desired resistance, the width of the crossbar 34 and bracket, and the total amount of space required for each resilient resistance element 62. The exerciser 10 may be operated with any number of resilient resistance elements 62 installed in the slots.

The tensile resilient resistance elements 62 illustrated in FIGS. 1 and 2 are elastomeric cords with knobs 64 installed at the ends, so that the ends may be seated in the slots provided for them. The tensile resilient resistance elements 62 may also comprise tension coil springs, rubber bands, or similar structures. Depending on the type of resilient resistance elements 62, hooks or other receiving structures may be used instead of slots. As those of skill in the art will appreciate, one of the functions of the tensile resilient resistance elements 62 is to bias the movable body support 14 to return to a position proximate to the movable foot support 16 when moved by the user away from the movable foot support 16. However, particularly if the movable body support 14 is inclined and able to move under the influence of gravity, the resilient resistance system may be omitted.

The exerciser 10 of FIG. 1 also carries an arm exercise system. Two pull lines 56 are connected to the underside of the movable body support 14. From the underside of the movable body support 14, the pull lines 56 are trained over pulleys 58 that are carried by an upright bar 66 provided on the end of the exerciser opposite the foot support. The pulleys 58 are adapted to swivel, so as to allow the user to pull the pull lines 56 toward the foot support 16 in a variety of planes of motion. They pulleys 58 are also releasably mounted on the upright bar 66 by mounting structure 68 so that their angle and orientation can be changed by the user.

From the pulleys 58, the pull lines 56 extend towards the foot support 16, and are coupled to user grips 70 at their ends. Between the ends of the pull lines 56 and the user grips 70, take-up fittings 72 are provided. Each take-up fitting has a number of holes 74 formed in it, such that if the pull lines are too long, they may be wrapped around and through the take-up fittings 72 to reduce their effective lengths. When the user grips the user grips 70 and causes the pull lines 58 to extend, he or she is working against the force bias provided by the tensile resilient resistance elements 62. The arm exercise system, including the pull lines 56, pulleys 58 and associated structures is an optional feature, and may not be included in some embodiments of the invention.

The foot support 16 is constructed and adapted to yield in a controlled manner in response to the engagement of the user's feet therewith in a direction toward the foot support 16 and to establish, as a result of the controlled yielding, a bouncing movement by the foot support 16 in the opposite direction, which can be translated by the user into a movement of the movable body support 14 in that opposite direction. In this context, the term "bouncing movement" may refer to movements during which the feet of the user lose contact with the foot support 16, as well as resilient movements during which the feet of the user remain in contact with the foot support 16. The term "feet" may refer to both of the user's feet together or to one individual foot; the exercises shown described here may be performed with one foot, each foot alternately, or both feet simultaneously. The terms "controlled yielding" and "resilient yielding" imply that the foot support 16 or individual foot portions thereof yield in such a manner that they are biased to return to their original position. As was noted above, if the foot support 16 does not comprise a flexible sheet member 52, the foot support 16 is preferably designed to simulate the motion of a structure such as the flexible sheet member 52. That motion will be described below in more detail.

By the operation of the resilient resistance system, the movable body support 14 is constructed and arranged to absorb the energy of movement of the user on the movable body support in a direction away from the foot support 16 and to convert that absorbed energy into a movement toward the foot support 16.

The user may control the degree of resistive bias by changing the number of tensile resistive elements 62 that are connected between the crossbar 34 and the movable body support 14. The pull lines 56 are constructed and arranged such that forces applied in a direction toward the foot support 16 by the user's arms are converted into movements of the movable body support 14 away from the foot support 16. Alternatively, the user may control the position of the movable body support 14 solely by flexure of the legs against the foot support 16.

Figure 6A:
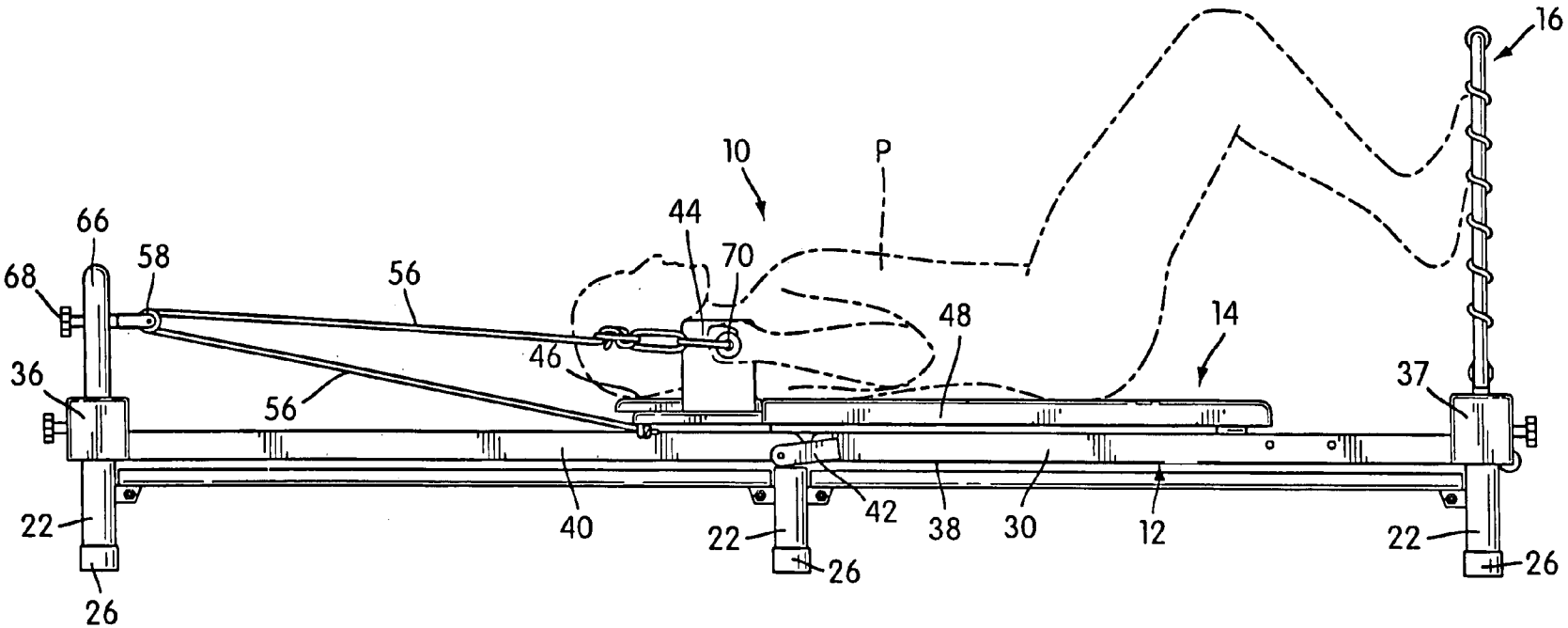
FIGS. 6A–6C are side elevational views of the exerciser of FIG. 1 in various operative positions.
Figure 6B:
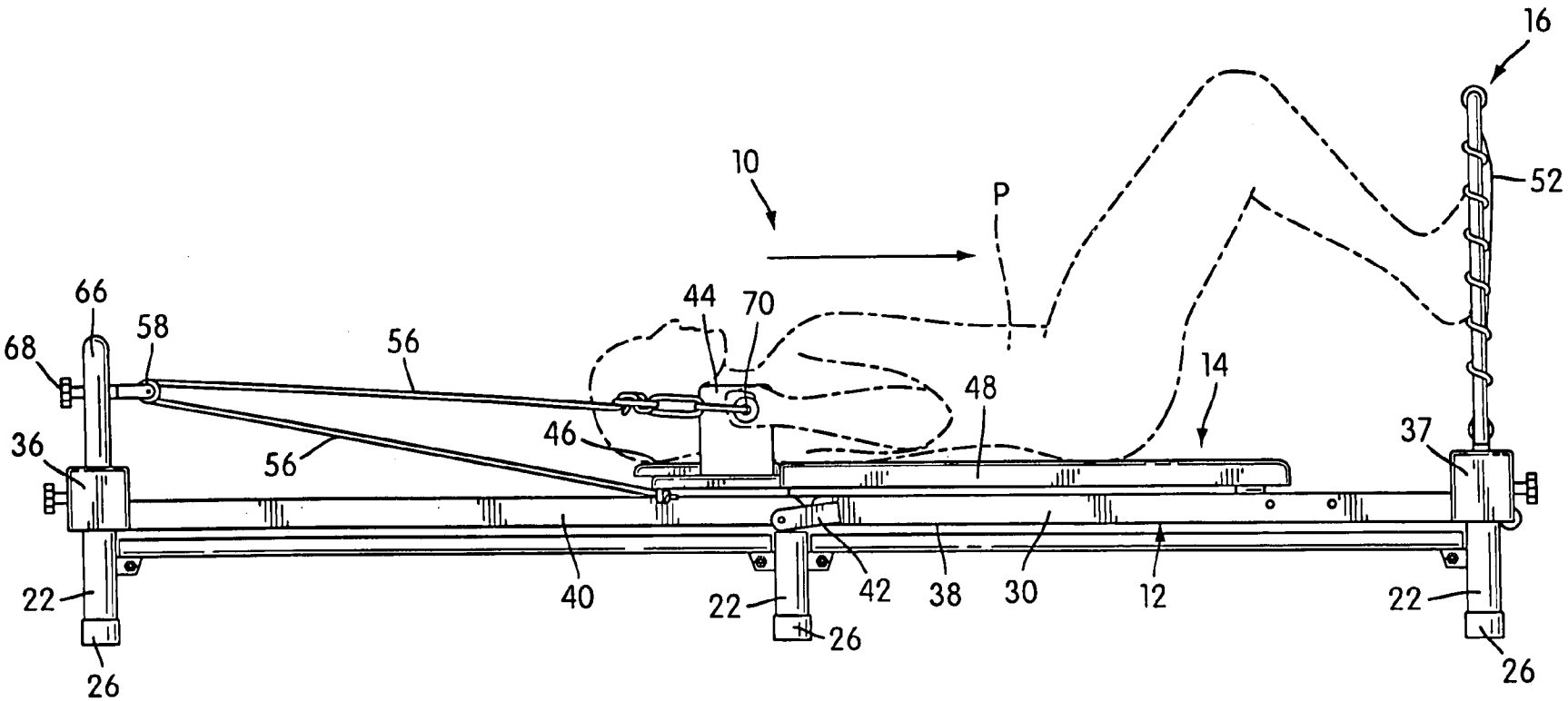
Figure 6C:
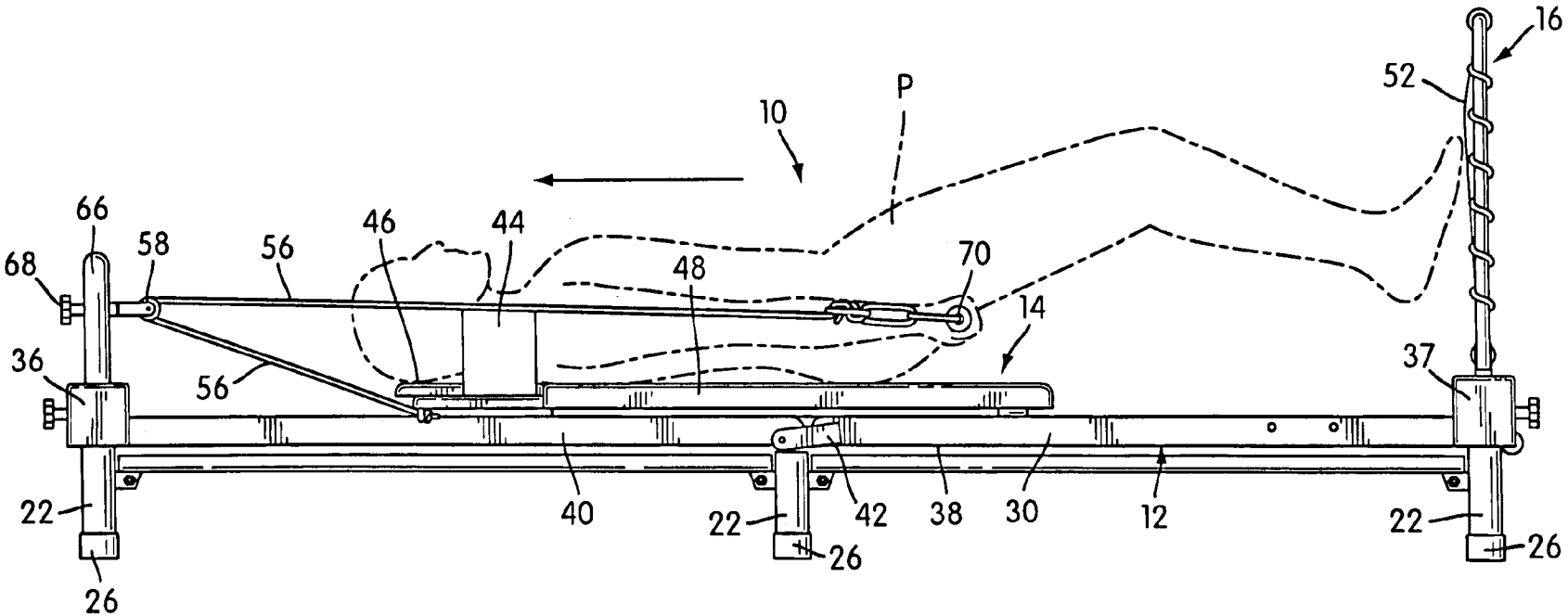

One exemplary type of exercise that may be performed with the exerciser 10 is shown in FIGS. 6A–6C, although many types of exercises may be performed. As shown in FIG. 6A, the user P lies on the movable body support 14 in an essentially supine position, flexed at the knees, with the bottoms of his or her feet in contact with the flexible sheet member 52 of the foot support 16. In FIG. 6A, the user P is also gripping the user grips 70, and the pull lines 56 are extended forwardly. In the view of FIG. 6B, the user P has moved the movable body support 14 towards the foot support 16, causing the flexible sheet member 52 to deflect. In the view of FIG. 6C, the resiliency of the elastomeric cords 62 attached to the flexible sheet member 52 has caused the flexible sheet member 52 to rebound, creating a bouncing movement by the foot support 16 that the user P can translate into a movement of the movable body support 14. As shown in the FIG. 6C, the movable body support 14 has moved in a direction away from the foot support 16. The degree of bouncing shown in FIG. 6C is for illustrative purposes. The actual amount of bouncing or resiliency will vary with the type of flexible sheet member 52 and elastomeric cords 62 that are used, as well as the way in which the user P controls the movement. The movements illustrated in FIGS. 6A–6C may be repeated any desired number of times at any desired frequency.

During the movements illustrated in FIGS. 6A–6C, the feet of the user P may or may not lose contact with the foot support 16, depending on how the user P controls the movement. If the feet of the user P do lose contact with the foot support 16 during the bouncing movement, the separation distance may be at least partially controlled by the user P by exerting the muscles of the legs and/or abdomen appropriately when initially contacting the foot support 16 or thereafter.

The exerciser 10 may be used for a number of different types of exercise; the positions shown in FIGS. 6A–6C are merely exemplary. In particular, the user P may exercise using any combination of arm, leg, or arm and leg movements. If the user P uses both arm and leg movements during the exercise motions, as is shown in FIGS. 6A–6C, the effects of the arms and legs on the movement of the movable body support 14 are additive. The use of the foot support 16 may be particularly helpful in exercising the abdominal muscles, because the flexed-knee position of the user P will cause some of the exercising forces to be absorbed by and/or exerted by the abdominal muscles.

Figure 7:
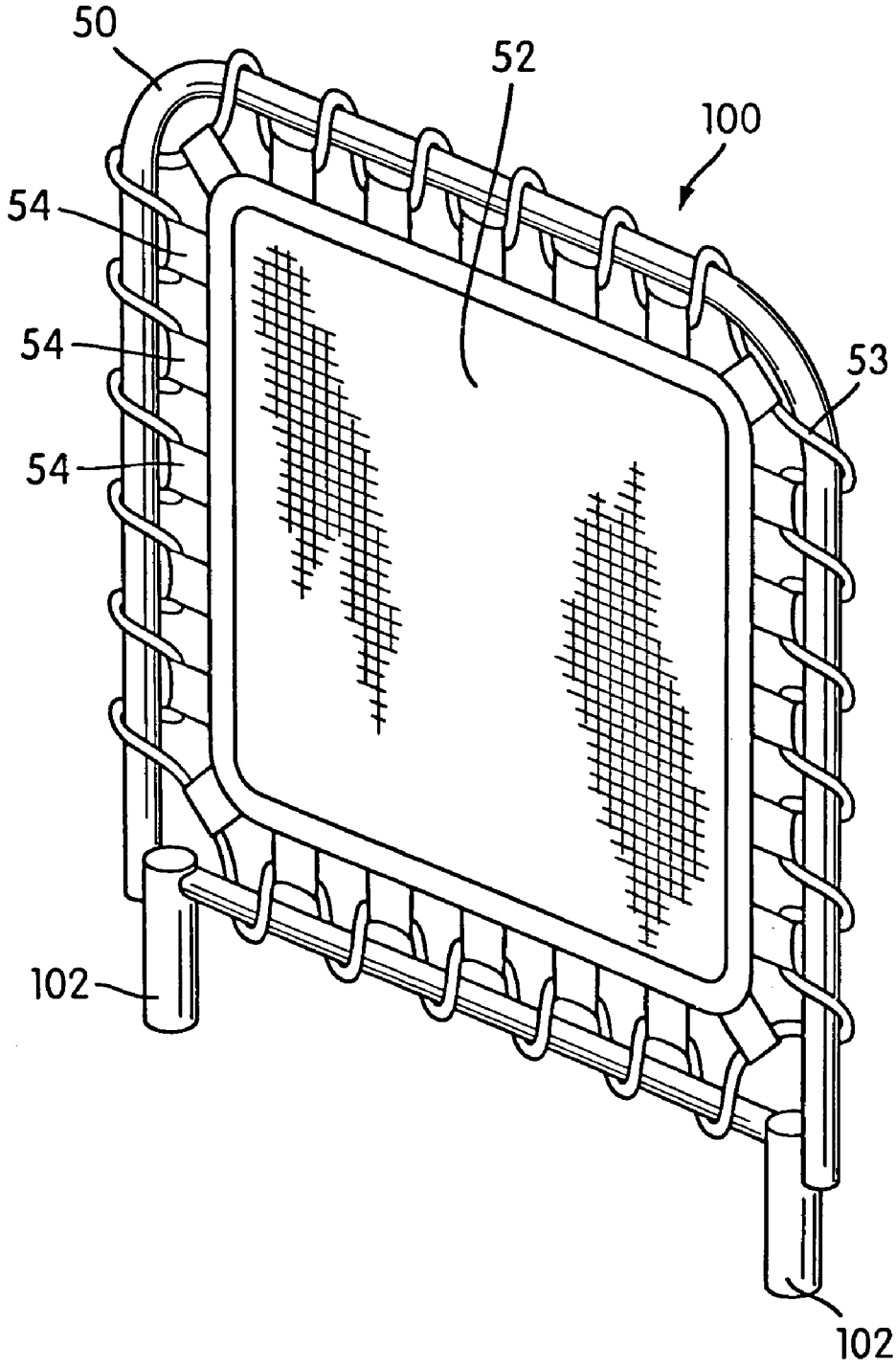
FIG. 7 is a perspective view illustrating an exerciser foot rest attachment according to the invention.

In addition to being installed on and included with an exercise machine like that shown in FIGS. 1–6, a foot support according to the invention may also be sold and used as a separate attachment constructed and arranged to be installed or retrofitted on an exercise apparatus in lieu of a conventional foot bar or foot support. FIG. 7 illustrates a foot support 100 as it might be sold or used as an attachment. The foot support 100 includes connecting structures or portions 102 for connecting the foot support 100 with appropriate receptacles provided in the exercise apparatus. Depending on the configuration of the exerciser, the connecting structures 102 may simply be the terminal portions of the frame member 50 of the foot support. Alternatively, they could be keyed or shaped shafts, or could include some other structure adapted to cooperate with the receptacles of the exerciser to lock the foot support 100 into position within the exerciser. Additionally, a foot support attachment 100 may have any of the features described above with respect to the foot support 16.

Figure 8:
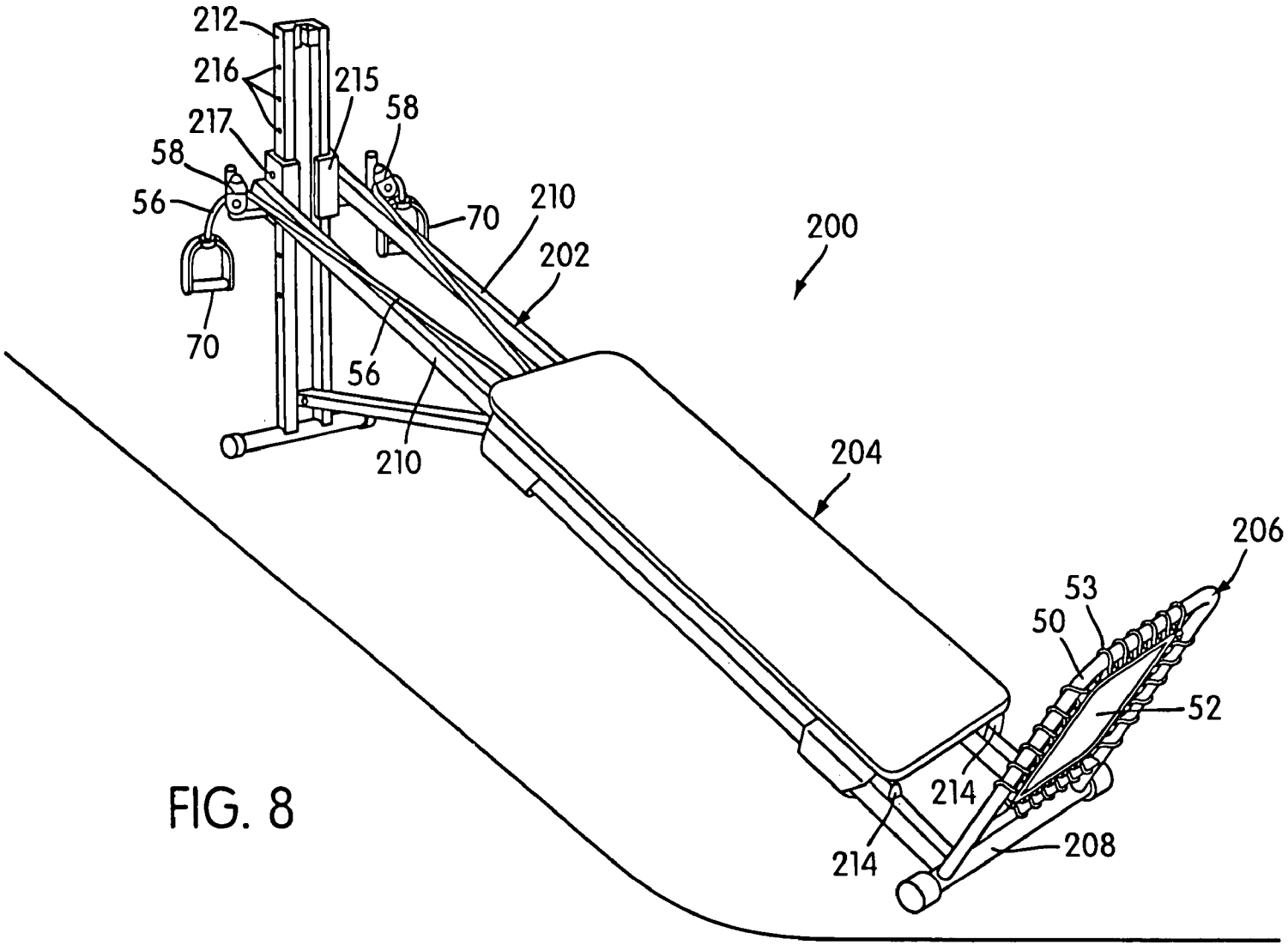
FIG. 8 is a perspective view of an exerciser according to another embodiment of the invention.

An exerciser 200 according to another embodiment of the invention is shown in the perspective view of FIG. 8. The exerciser 200 is generally of the type described in U.S. Pat. No. 5,967,955, which was incorporated by reference above, and it may incorporate some or all of the features of the exerciser described in that patent.

In general, the exerciser 200 includes a frame assembly, generally indicated at 202, a movable body support, generally indicated at 204, mounted on the frame assembly 202 for movement between limiting positions on the frame assembly 202, and a resiliently movable foot support, generally indicated at 206. The resiliently movable foot support 206 is essentially identical to the foot supports 16, 100 described above, with the exception that it is particularly adapted to be inserted into an end crossmember 208 provided at the foot end of the frame structure 202. Because the foot support 206 is essentially identical to the foot supports 16, 100 described above, the description above will suffice to describe it.

Figure 9:
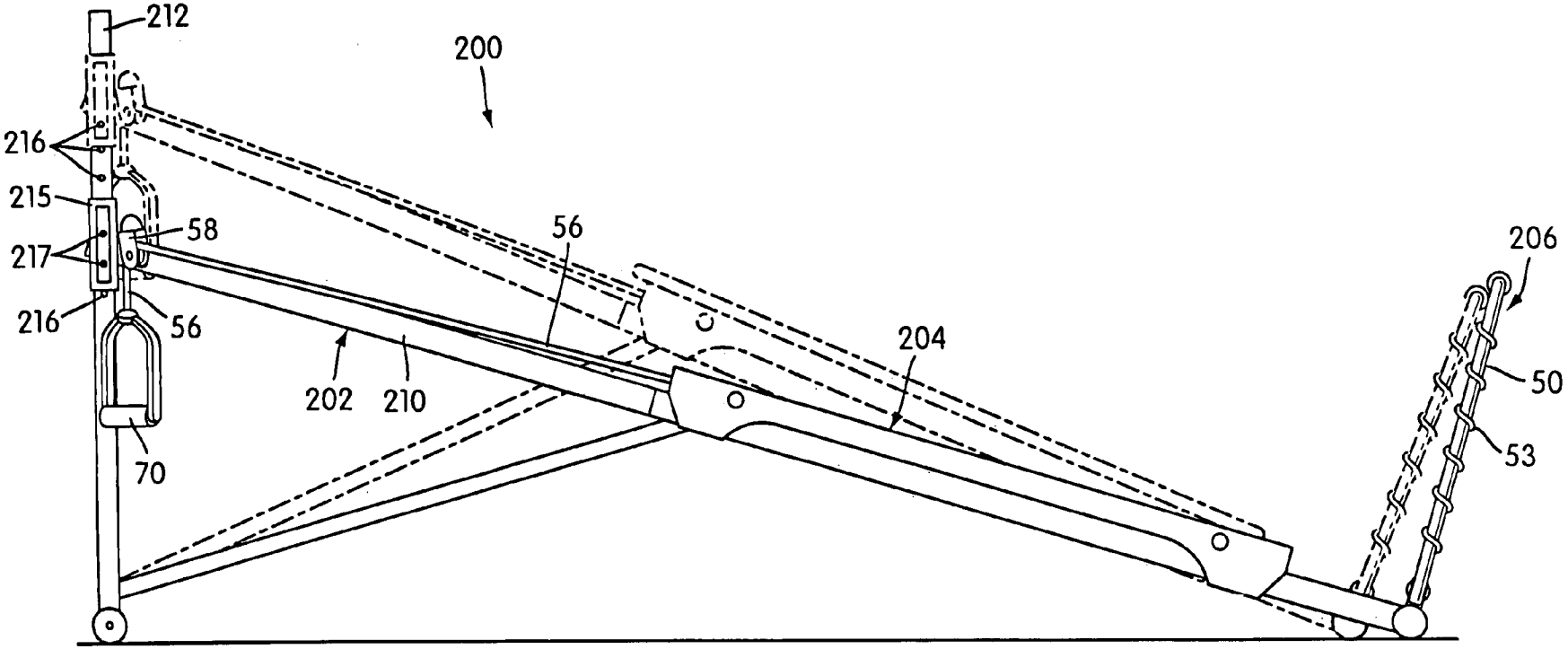
FIG. 9 is a side elevational view of the exerciser of FIG. 8.

The exerciser 200 does not include a resilient resistance system; instead, as shown in the side elevational view of FIG. 9, the frame assembly 202 includes two generally parallel support tracks 210, which are supported on an inclined plane by a stand 212. With this arrangement, the movable body support 204 is mounted for movement along the inclined plane defined by the tracks 210. The tracks 210 of the exerciser 200 of this embodiment do not include interior tracks; instead, the movable body support 204 rests on top of the tracks 210, and is supported by rollers 214.

As supported by the stand 212 on the inclined plane, the movable body support 204 absorbs the energy of movement of a user supported thereon moving along the tracks 210 up the inclined plane because the user is working against the influence of gravity, and is thus storing potential energy. The movable body support 204 converts the absorbed energy into a movement along the tracks 210 down the inclined plane because the absorbed/stored potential energy is converted to kinetic energy.

In other words, the user is working against a portion of his or her own body weight, which provides the user with exercising resistance. The amount of exercising resistance may be varied by varying the incline of the tracks 210. As shown, the stand 212 includes a connecting bracket 215 which may be supported at any one of a number of support points 216. In the illustrated embodiment, the support points 216 are holes positioned at regular intervals along the height of the stand 212. Each hole 216 is constructed and arranged to receive a pin inserted through a corresponding hole 217 in the connecting bracket. However, the support points 216 may be outwardly projecting members or any other type of structure capable of supporting the weight of the tracks 210 with the user positioned on them. In FIG. 9, a second angular position of the tracks 210 is drawn in phantom. Despite the difference in resistive systems, the foot support 206 functions in essentially the same way as shown in FIGS. 6A–6C.

The movable body support 204 is also connected to pull lines 56 which are trained over pulleys 58 carried by the frame assembly 202, such that the pull lines 56 may be pulled forwardly, towards the foot support 206, which movement moves the movable body support 204 in a direction away from the foot support 206. The ends of the pull lines 56 are provided with grips 70. As with the exerciser 10 of the previous embodiment, the user may use any combination of arm, leg, or arm and leg movements to move the movable body support, and the effects of both arm and leg movements are additive.

It will be noted that in both the horizontal exerciser of FIGS. 1–6C and the inclined exerciser of FIGS. 8–9, the main weight of the user is borne by the body support 14, 204. In its broadest aspect, the invention contemplates a vertical orientation of the body support 14, 204, in which case the body of the user P is supported on the body support 14, 204 to move with the body support 14, 204 without significant body weight support.

In the exercisers described above, the foot support 16 is a unitary structure that provides a single surface for contacting both of the user's feet. However, in other embodiments of the invention, individual foot supports, or individual contact areas, may be provided for each foot.

Figure 10:
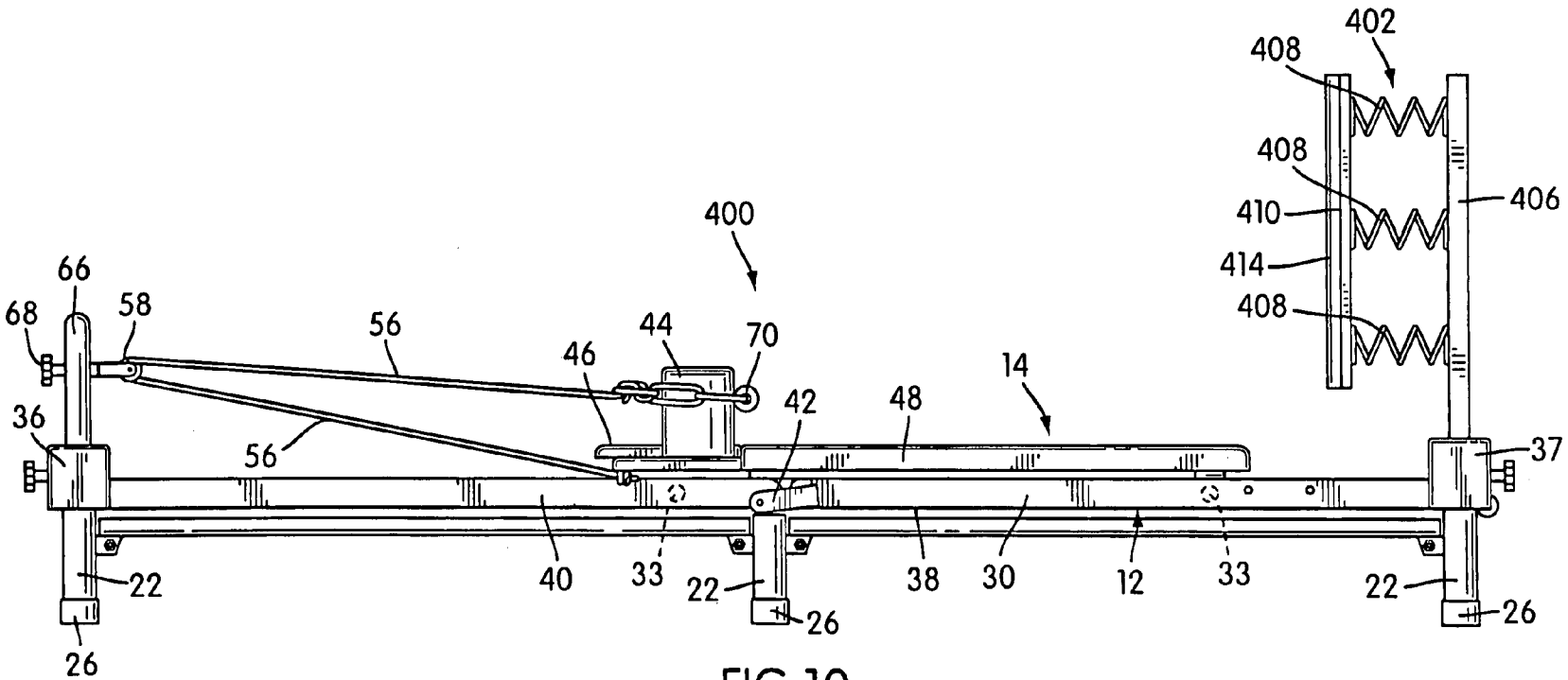
FIG. 10 is a side elevational view of an exerciser according to yet another embodiment of the invention.
Figure 12:
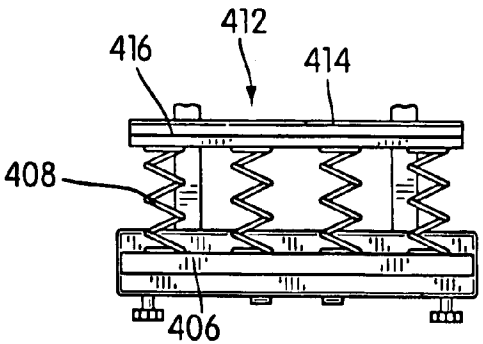
FIG. 12 is a top plan view of a foot support portion according to another embodiment of the invention, the exerciser itself being generally the same as that shown in FIG. 10.
Figure 11:
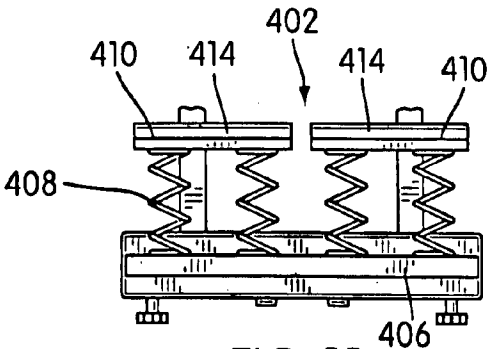
FIG. 11 is a top plan view of the foot support portion of the exerciser of FIG. 10.

An additional embodiment of the invention is shown in the side elevational view of FIG. 10. FIG. 10 illustrates an exerciser 400 having a foot support (or "trampoline", as this term is used herein to refer to a rebounding structure that utilizes spring force) 402 that comprises two individual foot contact portions 410 connected to a vertically extending support 406 by compression springs 408. The foot contact portions 410 extend horizontally forward from the vertically extending support 406. FIG. 11 is a top plan view of the foot support 402 showing the two individual foot contact portions 410. Each foot contact portion 410 is sized to accommodate one of the user's feet. In another embodiment shown in the top plan view of FIG. 12, a foot support or trampoline 412 includes a unitary foot contact portion 416 sized to accommodate both feet. In each case, the foot support 402, 412 would be provided with a layer of foam or other padding material 414 to provide comfort and traction for the user's feet. Those of skill in the art will note that the exercising motion enabled by the foot support 412 is similar to the exercising motion enabled by the foot support 16 described above. As will be apparent to those skilled in the art, the foot supports 402, 412 of FIGS. 10–12 may also be used as attachments to be installed on or retrofit to existing exercises apparatuses.

Further embodiments of the invention may combine attributes of the exercisers 10, 200, 400 described above. Moreover, some embodiments may add additional features and levels of user adaptability that are desirable in professional exercise settings, such as gyms and exercise studios.

The exercisers according to the present invention provide several advantages. First, the user can perform exercises in a supine position, which is usually at least perceived by the user to be more comfortable. Second, the type of exercises that can be performed on exercisers according to the invention may have cardiovascular, strength, and flexibility benefits. Third, as was described above, certain known types of exercises, such as Pilates exercises, may be performed on exercisers according to the invention, if desired by the user.

Although the invention has been described with respect to certain embodiments, those of ordinary skill in the art will realize that modifications may be made within the scope of the invention.

What is claimed is:

1. An exerciser comprising:

a track;

a stand that supports the track in an inclined configuration;

a movable body support mounted on said track to enable translational movement of said movable body support;

a trampoline arranged to be engaged by feet of an exercising person supported by the movable body support;

said movable body support being movable in a first direction away from said trampoline and a second direction toward said trampoline, wherein a gravity pull moves the body support in the second direction toward the trampoline;

said trampoline having a portion thereof being elastically deformable upon receipt of force applied by the feet of the exercising person, wherein such elastic deformation applies a force against the feet of the exercising person to facilitate a movement of said movable body support in said first direction away from said trampoline.

2. The exerciser according to claim 1, further comprising elongated resilient elements coupled to the movable body support and being elastically stretched during movement of the movable body support in the first direction away from the trampoline.

3. The exerciser according to claim 2, wherein stretching of said elongated resilient elements generates stored energy in said elastic resilient elements that can be used to facilitate movement of said movable body support in said second direction.

4. The exerciser according to claim 1, wherein said trampoline comprises a frame, and wherein said elastically deformable portion comprises a flexible sheet attached to the frame.

5. The exerciser according to claim 1, wherein the elastically deformable portion comprises a flexible sheet.

6. The exerciser according to claim 1, wherein the trampoline comprises a rigid foot engaging portion and wherein the elastically deformable portion comprises an elastically deformable spring coupled with said foot engaging portion.

7. The exerciser according to claim 1, wherein the body support is linearly movable on the track as the body support is moved toward and away from the trampoline.

8. An exerciser comprising:

a frame assembly;

a track carried by said frame assembly;

a movable body support mounted for linear movement on said track;

a trampoline assembly operatively connected to said frame assembly and including a flexible resilient sheet arranged to be engaged by the feet of an exercising person on the movable body support;

said movable body support being movable in a first direction away from said trampoline assembly and a second direction toward said trampoline assembly; and a resilient structure operatively connected to said movable body support to bias said movable body support toward said trampoline assembly.

9. The exerciser according to claim 8, wherein a stand is constructed and arranged to enable the track to be positioned in an inclined configuration.

10. The exerciser according to claim 8, wherein the trampoline assembly further comprises a peripheral frame, and wherein the flexible resilient sheet is connected to the peripheral frame.

11. The exerciser according to claim 9, wherein the stand is adjustable to change an angle of inclination of the track.

12. The exerciser according to claim 1, wherein the stand is adjustable to change an angle of inclination of The track.

* * * * *